US011808542B2

(12) United States Patent
Junge et al.

(10) Patent No.: US 11,808,542 B2
(45) Date of Patent: Nov. 7, 2023

(54) EXTENDED SLIDE STOP

(71) Applicant: AJ'S PRODUCTS, LLC, Jeffersonville, KY (US)

(72) Inventors: Ryan Junge, Jeffersonville, KY (US); Barry Alexander, Clay City, KY (US)

(73) Assignee: AJ'S PRODUCTS, LLC, Jeffersonville, KY (US)

( * ) Notice: Subject to any disclaimer, the term of this patent is extended or adjusted under 35 U.S.C. 154(b) by 0 days.

(21) Appl. No.: 17/932,777

(22) Filed: Sep. 16, 2022

(65) Prior Publication Data

US 2023/0168052 A1 Jun. 1, 2023

Related U.S. Application Data

(60) Provisional application No. 63/261,326, filed on Sep. 17, 2021.

(51) Int. Cl.

| | |
|---|---|
| ***F41A 3/68*** | (2006.01) |
| ***F41A 3/72*** | (2006.01) |
| ***F41A 3/66*** | (2006.01) |
| *F41A 5/02* | (2006.01) |

(52) U.S. Cl.

CPC *F41A 3/72* (2013.01); *F41A 3/66* (2013.01); *F41A 3/68* (2013.01); *F41A 5/02* (2013.01)

(58) Field of Classification Search

CPC ..... F41A 17/36; F41A 35/00; F41A 35/06; F41A 3/68; F41A 3/66

USPC ..... 89/194–196; 42/7

See application file for complete search history.

(56) References Cited

U.S. PATENT DOCUMENTS

| | | | | |
|---|---|---|---|---|
| 708,794 | A | 9/1902 | Browning | |
| 808,008 | A | 12/1905 | Browning | |
| 984,519 | A | 2/1911 | Browning | |
| 2,115,041 | A * | 4/1938 | Obregon | F41A 17/38 89/196 |
| 2,169,084 | A | 8/1939 | Swartz | |
| 4,539,889 | A | 9/1985 | Glock | |
| 4,915,011 | A | 4/1990 | Smith | |
| 5,070,634 | A * | 12/1991 | Marino | F41A 35/06 42/70.01 |

(Continued)

OTHER PUBLICATIONS

"Brownells 1911 Auto", Catalog, Brownells.com, 51 pages.

(Continued)

*Primary Examiner* — Reginald S Tillman, Jr.

(74) *Attorney, Agent, or Firm* — McKee, Voorhees & Sease, PLC

(57) ABSTRACT

An accessory slide stop is retrofit for commercially available and military application pistols. The slide stop acts as an add-on lever that replaces an existing lever of the pistol. The slide stop helps decrease the time it takes to reload the pistol. The slide stop is an extended body over that which is known in the art. The slide stop optimizes a position from which the slide stop can be hit by the operator, allows the operator to use either hand as the his or her support hand (non-trigger hand) without having to include two slide stops on each side of the pistol, and even changes the direction in which the operator is allowed to hit the slide stop in order to release the slide such that it is consistent with the direction in which the operator's support hand is already traveling as a result of reloading a charged magazine into the pistol.

19 Claims, 11 Drawing Sheets

(56) References Cited

U.S. PATENT DOCUMENTS

| | | | |
|---|---|---|---|
| 5,129,172 | A | 7/1992 | Brennan |
| 7,395,627 | B2 | 7/2008 | La France et al. |
| 7,698,845 | B2 | 4/2010 | Hochstrate et al. |
| D661,766 | S | 6/2012 | Siddle et al. |
| 8,418,391 | B2 | 4/2013 | Kemmerer et al. |
| D702,308 | S | 4/2014 | Glock |
| 9,435,592 | B2 | 9/2016 | Curry |
| 9,482,480 | B2 | 11/2016 | O'Dell |
| 9,651,326 | B2 | 5/2017 | Weilharter |
| 9,952,009 | B2 | 4/2018 | Buchel et al. |
| D828,892 | S | 9/2018 | Kellgren |
| 10,551,137 | B2 | 2/2020 | Hudson, III et al. |

OTHER PUBLICATIONS

"Brownells Pistol" Catalog, Brownells.com, 30 pages.
"Wilson Combat 1911 Training Tip: Reloading", Youtube Video, www.youtube.com/watch?v=47dbkOjmN_w, 1 page, pulled Aug. 2022.

* cited by examiner

EXTENDED SLIDE STOP

CROSS REFERENCE TO RELATED APPLICATIONS

This application claims priority under 35 U.S.C. § 119 to provisional patent application U.S. Ser. No. 63/261,326, filed Sep. 17, 2021. The provisional patent application is herein incorporated by reference in its entirety, including without limitation, the specification, claims, and abstract, as well as any figures, tables, appendices, or drawings thereof.

FIELD OF THE INVENTION

The present invention relates generally to handguns, the components thereof, and corresponding methods of assembling/manufacturing said components. The present invention has industrial applications in at least the arms trade. More particularly, but not exclusively, the present invention relates to an extended slide stop for a pistol, such as a single-action, semi-automatic, magazine-fed, recoil-operated pistol like the M1911.

BACKGROUND OF THE INVENTION

The background description provided herein gives context for the present disclosure. Work of the presently named inventors, as well as aspects of the description that may not otherwise qualify as prior art at the time of filing, are neither expressly nor impliedly admitted as prior art.

Pistols employing mechanisms or systems operated by propellant charge energy for automatically opening the lock recoil-operated the barrel being tilted during recoil often include a slide stop capable of releasing the slide. The operator typically releases the slide after emptying the magazine of the gun and replacing the empty magazine of the gun with a charged magazine. This action allows the firearm to move from a recoil position to a forward position such that the firearm can be fired again.

The original design for the M1911 is shown in U.S. Pat. No. 984,519. U.S. Pat. No. 984,519 was granted to J. M. Browning in 1912 and is herein incorporated by reference in its entirety. Browning disclosed a pivot-pin provided with a handle which projects at a right angle from the end of the pin. The pivot pin extended rearward and rested against the left side of the frame when the pin is in its place. In order to adapt the handle to be readily moved upward and downward by the thumb of the hand grasping the grip, the rear end of the handle typically carries a projecting thumb piece. A lug projects from the handle inward through an opening in the side of the frame into the top of the magazine seat. This opening in the frame permits a limited movement vertically to the handle, for which the pivot-pin turns in its seat. Within the thumbpiece, a small piston and spiral spring are secured. While a round stud projects from the frame at the rear of the handle, the protruding end of the spring-pressed piston bears against the stud and yieldingly holds the handle in either the raised or lowered position to which it may be moved at will by pressure on the thumbpiece. On the outside of the frame above the thumbpiece, the handle carries an upward projection, and the breech-slide has a corresponding recess in its lower edge, both projection and recess being square at the rear and inclining at the front.

The inner end of the lug does not interfere with the passage of the cartridges from the magazine to the chamber in the barrel. When the last cartridge has been fed from the magazine, the lug stands in the path of the spring-follower of the magazine. When the breech-slide is moved to the rear above the empty magazine, the follower will raise the lug and the handle and cause the projection to enter the recess in the breech-slide, thereby locking the same in the open rear position. This serves as an indicator to show that the empty magazine must be replaced by a charged one before firing can continue. After placing the magazine in the grip, the breech-slide is released by depressing the handle.

A slide stop actuated by the magazine follower to arrest the breech-slide in the open position when the magazine is empty is described and shown in U.S. Pat. No. 708,794, granted to J. M. Browning in 1902, herein incorporated by reference in its entirety. The construction of the slide stop as an integral part of the handle of the pivot-pin securing the barrel and the breech slide upon the frame is shown in U.S. Pat. No. 984,519. The design of the '519 Patent reduces the number of parts and simplified the dismounting and assembling of the arm described in the '794 Patent.

Reloading the M1911 can be particularly problematic because the slide stop is: (i) poorly located, (ii) located on only one side of the firearm in such a manner that requires the operator to use a specific hand as the support hand, and (iii) requires the operator to push downward to release the slide even though the operator's previous action is to push the magazine upward into the magazine seat during reloading.

Some experts are known to reload the M1911 gun once the slide locks to the rear as follows. When the gun runs dry, the operator drops the empty magazine. The operator comes up with new magazine and must critically consider options of how best to release the slide.

There are two standard options. In the first option, the operator seats the new magazine in the gun and brings their left thumb (of the support hand) up and releases the slide. This first option takes significant time to reload the firearm, which is simply unacceptable where a difference of a few tenths of a second can mean the difference between life and death for the operator.

The other option the operator has is to use the 'slingshot' or 'power stroke' method. This method involves bringing the support hand up toward the rear of the firearm, rolling the support across the top of the firearm, and manually pulling the slide to the rear to release the slide.

The second option requires taking the shock buff out of the gun. If the shock buff is left inside the gun during use of this method, the fiber buffers of same will cushion the slide to frame impact and will not allow the slide to move rearward enough to release the slide release to allow the round to be chambered into the gun. This method is too complicated for most operators, whilst simultaneously losing the functional advantages provided that were once provided by fiber buffers of the shock buff.

Thus, there exists a need in the art for an apparatus which decreases the time it takes to re-load and fire the firearm.

SUMMARY OF THE INVENTION

The following objects, features, advantages, aspects, and/or embodiments, are not exhaustive and do not limit the overall disclosure. No single embodiment need provide each and every object, feature, or advantage. Any of the objects, features, advantages, aspects, and/or embodiments disclosed herein can be integrated with one another, either in full or in part.

It is a primary object, feature, and/or advantage of the present invention to improve on or overcome the deficiencies in the art.

It is a further object, feature, and/or advantage of the present invention to increase the speed in which an operator of the firearm can reload, without requiring undue amounts practice and/or training with the firearm. For example, use of the improved extended slide stop described herein can save as much as five seconds between firing ammo of different magazines for an operator of average skill handling arms. Those operators of below average skill can stand to make up even more time, whilst even highly trained operators will still appreciate the ability to shave even as low as a few tenths of a second between firing rounds of different magazines.

It is still yet a further object, feature, and/or advantage of the present invention to adapt an ambidextrous model for the slide stop that allows the operator to use either hand to release the slide.

It is still yet a further object, feature, and/or advantage of the present invention to better locate the position at which the slide stop must be pressed by an operator in order to release the slide.

It is still yet a further object, feature, and/or advantage of the present invention to further reduce the number of parts and/or simplify steps involved when reloading magazines.

It is still yet a further object, feature, and/or advantage of the present invention to provide an extended slide stop that can be easily used by both left-handed and right-handed operators.

It is still yet a further object, feature, and/or advantage of the present invention to retrofit an extended slide stop for existing models of firearms so that operators are not required to purchase new firearms in order to gain access to the benefits of the invention. This is however not required, and the extended slide stop would still over the same benefits even if provided by the Original Equipment Manufacturer ("OEM") at the time of purchase.

The extended slide stop disclosed herein can be used in a wide variety of applications. For example, aspects of the extended slide stop described herein can be applied to a wide variety of firearms that have non-ideal slide stops, including, but not limited to: the Kimber Custom, AMT Hardballer, Ballester-Molina, Obregon pistol, Kongsberg Colt, Star Model BM, Glock, and the like. Moreover, the extended slide stop can be used for arms intended to be kept in residential homes or for military applications.

It is preferred the apparatus be safe, cost effective, and durable. For example, the extended slide stop should adequately resist thermal transfer, electric conductivity, and/or failure (e.g., cracking, crumbling, shearing, creeping) due to excessive and/or prolonged exposure to tensile, compressive, and/or balanced forces acting on the apparatus.

At least one embodiment disclosed herein comprises a distinct aesthetic appearance. Ornamental aspects included in such an embodiment can help capture a consumer's attention and/or identify a source of origin of a product being sold. Said ornamental aspects will not impede functionality of the present invention.

Methods can be practiced which facilitate use, manufacture, assembly, maintenance, and repair of an extended slide stop which accomplish some or all of the previously stated objectives. For example, the slide stop and its many surfaces can all be manufactured from long-wearing, hardened, heat treated steel. The slide stop can be manufactured with precision machining.

According to some aspects of the present disclosure, the extended slide stop is manufactured such that the overall design is asymmetrical with respect every potential axis of the slide stop. This is a significant advantage over the prior art because it further ensures the extended slide stop cannot be inadvertently assembled incorrectly onto the gun. The asymmetrical design further stabilizes the slide stop in relation to other components of the firearm and can prevent the slide stop from jarring loose over time or frequent repeated use.

According to some other aspects of the present disclosure, the slide stop is of a length greater than that of the standard-length, factory slide stop, The style and length disclosed herein is preferred by combat shooters, in part because it causes the contact surface of the slide stop is located at a more forward position of the firearm than the trigger.

The extended slide stop can be incorporated into arms which accomplish some or all of the previously stated objectives. Such firearms can, for exemplary purposes, comprise a handle comprising a grip; a frame extending substantially orthogonal to said handle; a slide slidably attached at a top of the frame; a barrel located within the frame and the slide; the slide stop according to any one or more of the aspects described in this section; and a trigger that when pulled, allows a hammer to release a bullet through said barrel if a cartridge containing the bullet is located within a magazine properly seated within the firearm; and/or a seat for a magazine, said seat being located within the handle. The firearm can be a single-action, semi-automatic, magazine-fed, recoil-operated pistol or a polymer-framed, short recoil-operated, locked-breech semi-automatic pistol.

According to some aspects of the present disclosure, a slide stop comprises an elongated body with a first end, a second end located opposite the first end, and a mechanism for releasing a slide of a firearm, said mechanism located near the first end; a contact surface extending from the second end, said contact surface being at least twice as wide as a width of the elongated body near said second end; and a mountable member extending away from a central location the body at a substantially orthogonal angle.

According to some additional aspects of the present disclosure: the contact surface is curved concave toward the direction that the rod extends from the elongated body; the mechanism is a latch (catch); and/or the mountable member is a rod. The mountable member can be configured to act as a fulcrum such that when an operator presses downward on the first portion, the second, extended portion travels upward, and vice-versa.

According to some additional aspects of the present disclosure, the body comprises a raised surface at the first end. The raised surface is raised from the body in a direction opposite the direction the mountable member extends away from the body. The body can comprise a first portion extending from the first end to the mountable member and a second, extended portion from the mountable member to the second end. The first portion, the second, extended portion, and the contact surface can each comprise approximately the same length. A first, elongated aperture can be centrally located within the first portion. A second, elongated aperture can be located partially within the second, extended portion and partially within the contact surface.

According to some additional aspects of the disclosure, the slide stop is designed to change a direction in which the operator must rotate the slide stop in order to release a slide of the firearm.

These and/or other objects, features, advantages, aspects, and/or embodiments will become apparent to those skilled in the art after reviewing the following brief and detailed descriptions of the drawings. Furthermore, the present disclosure encompasses aspects and/or embodiments not expressly disclosed but which can be understood from a reading of the present disclosure, including at least: (a) combinations of disclosed aspects and/or embodiments and/or (b) reasonable modifications not shown or described.

BRIEF DESCRIPTION OF THE DRAWINGS

Several embodiments in which the present invention can be practiced are illustrated and described in detail, wherein like reference characters represent like components throughout the several views. The drawings are presented for exemplary purposes and may not be to scale unless otherwise indicated.

Figure 1:
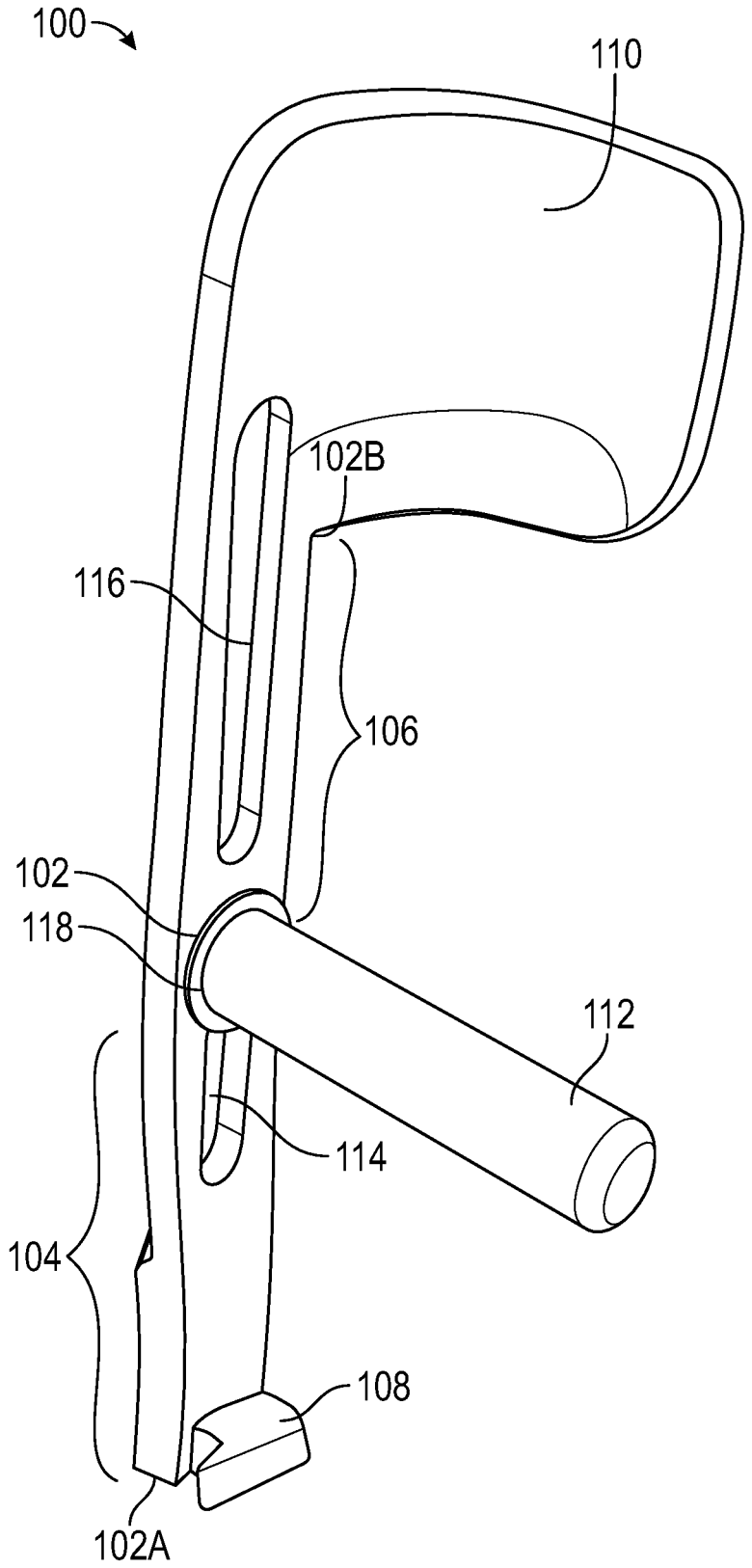
FIG. 1 shows a bottom perspective view of an extended slide stop.
Figure 2:
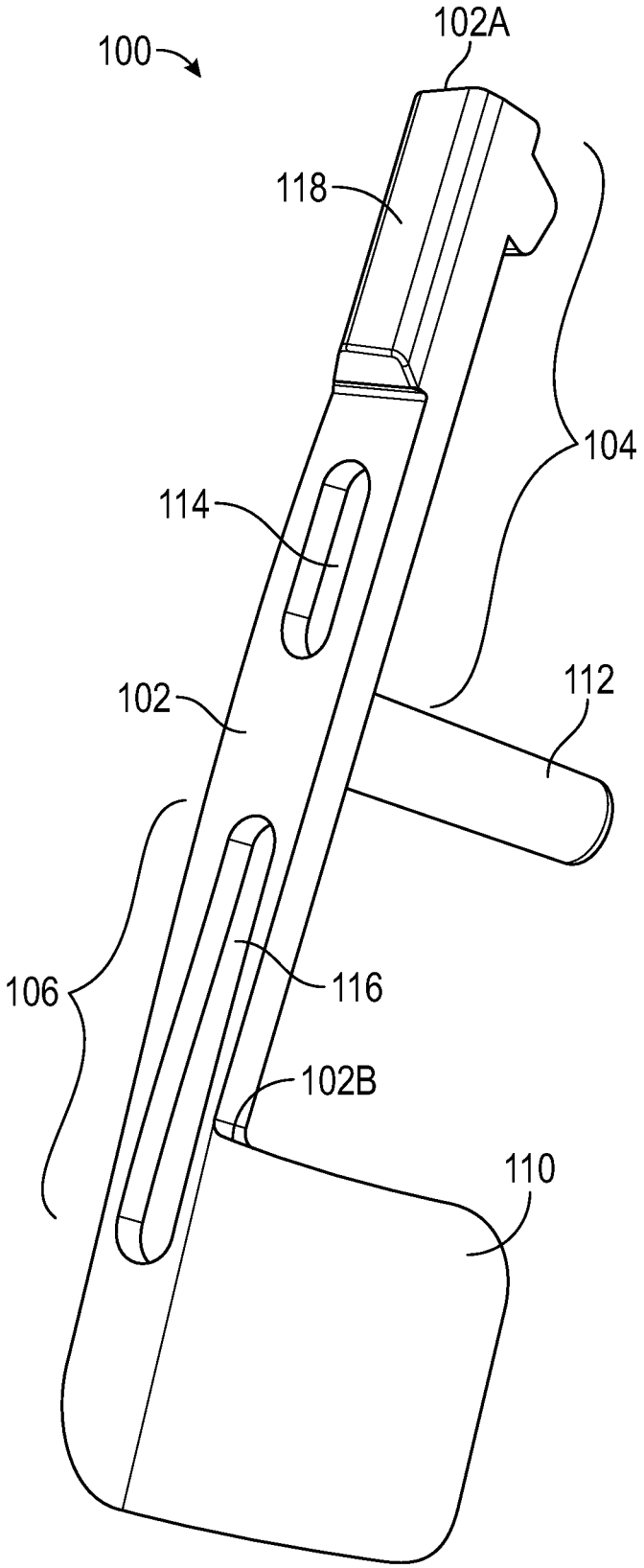
FIG. 2 shows a top perspective view of the extended slide stop of FIG. 1.
Figure 3A:
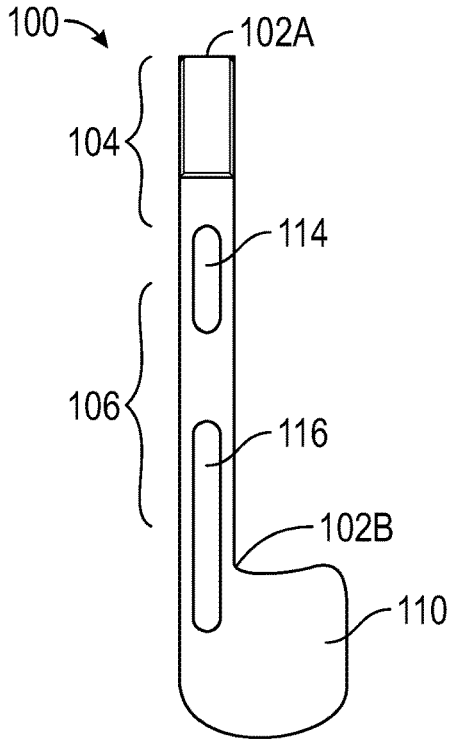
FIG. 3A projects a front elevation view of the extended slide stop of FIG. 1.
Figure 3B:
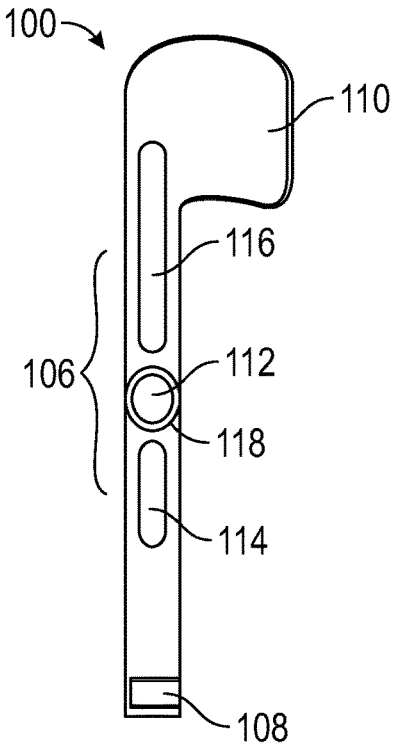
FIG. 3B projects a rear elevation view of the extended slide stop of FIG. 1.
Figure 3C:
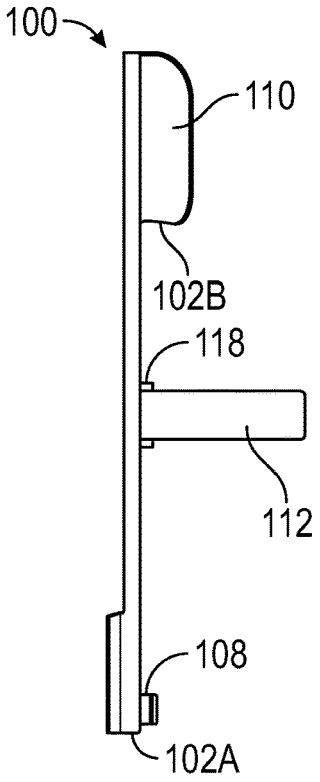
FIG. 3C projects a left-side elevation view of the extended slide stop of FIG. 1.
Figure 3D:
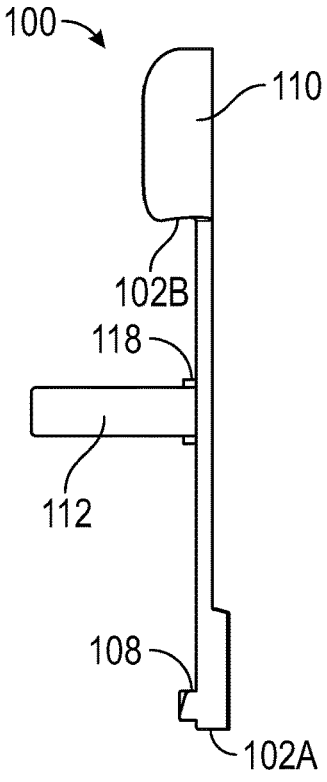
FIG. 3D projects a right-side elevation view of the extended slide stop of FIG. 1.
Figure 3E:
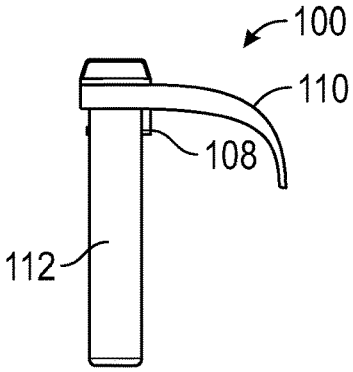
FIG. 3E projects a top plan view of the extended slide stop of FIG. 1.
Figure 3F:
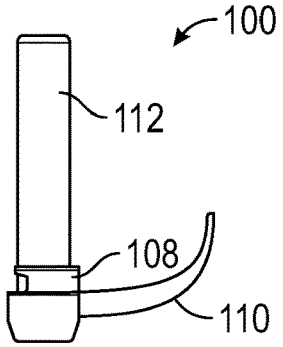
FIG. 3F projects a bottom plan view of the extended slide stop of FIG. 1.

An artisan of ordinary skill in the art need not view, within isolated figure(s), the near infinite number of distinct permutations of features described in the following detailed description to facilitate an understanding of the present invention.

DETAILED DESCRIPTION OF THE INVENTION

The present disclosure is not to be limited to that described herein. Mechanical, electrical, chemical, procedural, and/or other changes can be made without departing from the spirit and scope of the present invention. No features shown or described are essential to permit basic operation of the present invention unless otherwise indicated.

Referring now to the figures, FIGS. 1-2 and FIGS. 3A-3F show details of the extended slide stop 100. To employ the extended slide stop 100 on a particular firearm, the existing slide stop is preferably replaced in its entirety, though it is to be understood that there exist extensions having similar features to the integral extended slide stop 100 shown in the figures that can fit over existing slide stops so as to cause similar technical effects. The extended slide stop 100 can be custom made to retrofit almost any firearm 200, such as the one shown in FIG. 4 (a modern M1911, which is based off of the M1911 designed by J. M. Browning, originally designated with the formal name: "Automatic Pistol, Caliber 0.45, M1911"). The firearm 200 incorporates a short recoil principle in its design.

The improved slide stop 100 includes a body 102, typically formed from hardened, heat-treated steel. The body is an elongated member that includes a first end 102A and a second end 102B. The first end 102A is located adjacent a first portion 104 of the body and the second end 102B is located a second, extended portion 106 of the body 102. Implemented on a firearm 200, the first end 102A is a rearward end that includes the mechanism for engaging/disengaging the slide 208, such as a latch 108. This latch 108 is designed to disengage and automatically puts the slide 208 into a recoil position when a magazine in the firearm 200 is completely emptied. The latch 108 can re-engage the slide 208 when a contact surface 110 of the extended slide stop 100 is bumped upward.

The contact surface 110, when implemented on the firearm 200, is distinguishably located at a position more forward than the trigger 212 of the firearm 200. The contact surface 110 achieves this position by extending away from the second end 102B in a direction parallel to an axis running longitudinally through the elongated body 102. The contact surface 110 is preferably curved concave toward the direction that the rod 112 extends away from the body 102. Curving the contact surface 110 allow for more comfort when bumping same so as to release the slide 208.

The rod 112 acts as a dowel that fits into a hole of the frame 206 right above the trigger 212. Though the rod is shown as and is preferably characterized by a cylindrical shape, other suitable shapes can be used (or even warranted depending on the firearm design) for the rod 112. In other words, the rod 112 may have to be designed differently in position, size, and/or orientation if the model of pistol deviates. If the model of pistol deviates significantly, it is to be appreciated that other suitable mounting members aside from rods can be employed and the rod potentially omitted from the design. The internal end of the rod 112 can include a chamfered or filleted perimeter.

The rod 112 keeps the extended slide stop 100 stable during operation of the firearm 200. In some embodiments, the extended slide stop 100 can also be manufactured with an offset 118 (e.g., a raised surface), pin and lip engagement surface, and/or other surfaces that help cause tighter lockup with custom designs and/or custom barrels. The offset 118 can be, but is not limited to being, approximately 0.020 inches in thickness. The offset 118 can also help provide space to stop the slide stop from abrading and/or otherwise scratching the frame 206 from repeated use.

Optionally, to reduce weight of the slide stop without sacrificing too much durability, the body 102 can be partially hollowed to reduce the amount of material needed to manufacture the extended slide stop 100. To accomplish this, first and second oval-shaped apertures 114, 116 are included in the body 102. In some embodiments, the first aperture 114 is located in the first portion 114 and the second aperture 116 is located partially within each of the second portion 116 and contact surface 110. In a subset of said embodiments, there exist further embodiments where the first aperture 114 is approximately half the length of the length of the second aperture 116. Each aperture 114, 116 is relatively uniform in shape and dimension and extends the entire thickness through the body 102.

Figure 4:
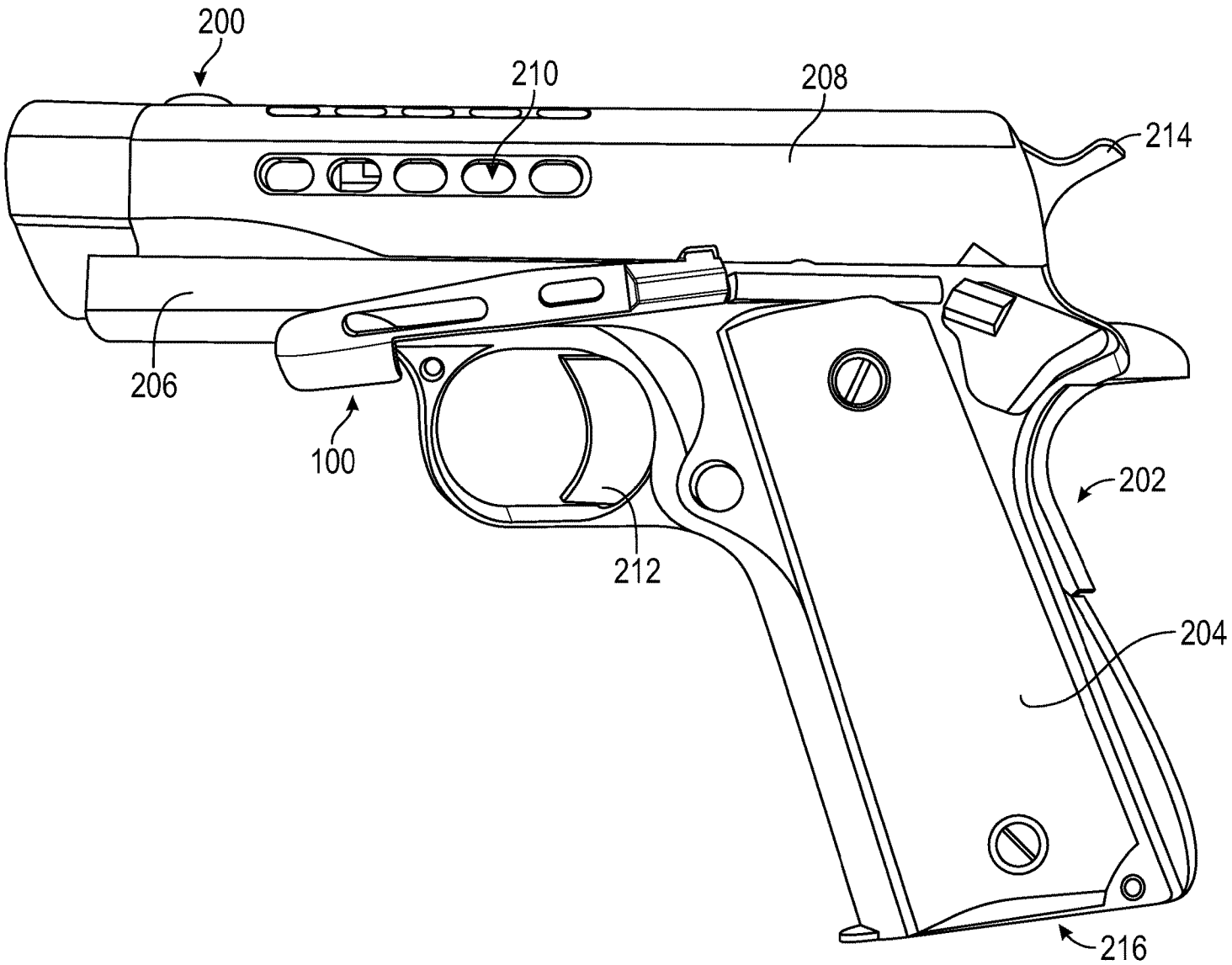
FIG. 4 implements the extended slide stop of FIG. 1 on a firearm.

With reference to FIG. 4, the firearm 200 includes major components such as the handle 202 (with stock 204 also shown), a frame 206, a slide 208, a barrel 210, a trigger 212, a hammer 214, and a magazine seat 216. The handle 202 attaches to the frame 206, which is further attached to the slide stop 100, slide 208, barrel 210, trigger 212, and hammer 214.

The handle 202 can be a pistol grip with a removable hand grip portion, or stock 204. The handle 202 distinctly protrudes from underneath the main mechanism, to be held by the user's hand at a more vertical (and thus more ergonomic) angle. The handle 202 extends away from the frame 206 at a substantially orthogonal angle or, in some embodiments, at an obtuse angle. The handle 202 allows for the ergonomic positioning the operating controls for use with minimal hand movement. The handle 202 is located behind the trigger 212 and generally held by the hand that operates the trigger 212. The handle 202 can facilitate the manipulation of the trigger 212. The handle 202 also houses the magazine via the magazine seat 216 and allows for the release of the magazine from said magazine seat 216.

Preferably, the handle 202 is configured to meet relevant regulations under United States gun laws so as to provide the user the ability to keep the firearm 200 in their home and to use the firearm 200 for purposes of self-defense. The handle 202 can be a defining feature that further allows the firearm 200 to be classified as a gun.

The slide 208 is slidably mounted to the top of the frame 206 and is selectively removable. The barrel 210 is a straight tube, usually made of rigid high-strength metal, through which a contained rapid expansion of high-pressure gas is used to propel a projectile out of the front end (muzzle) at a high velocity. The barrel 210 is preferred "blued" with a bluing process involves treating a gun with a solution that turns red iron oxide or rust ($Fe_2O_3$) into black iron oxide ($Fe_3O_4$).

It is to be appreciated that other components can also be blued and/or other surface finishes that result from a process other than bluing can also be used to improve the durability of any one or more components of the firearm 200.

Figure 5:
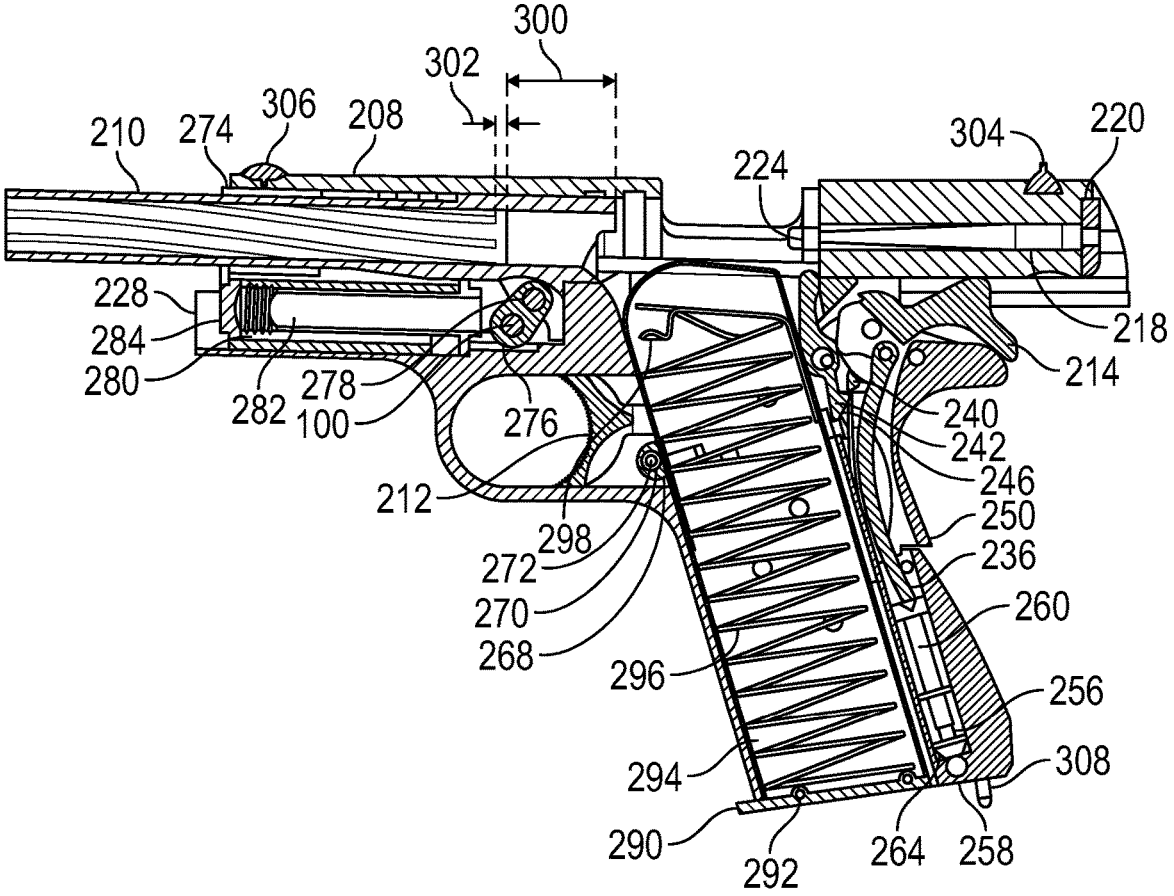
FIG. 5 shows a cross-sectional plan view of the firearm of FIG. 4.
Figure 6A:
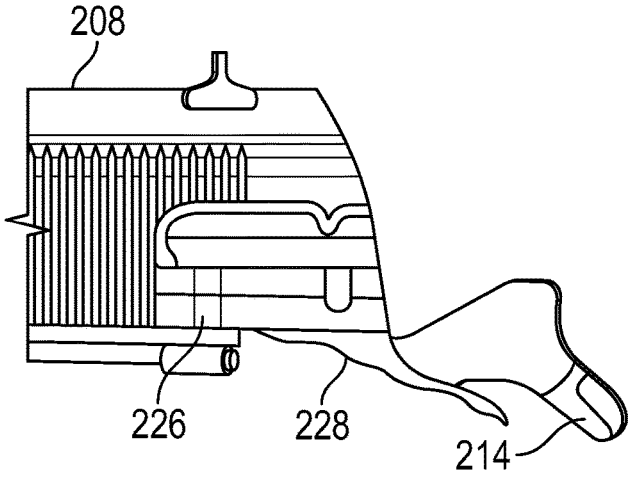
FIG. 6A shows a detailed, cutaway view of a hammer assembly of the firearm of FIG. 4.
Figure 6B:
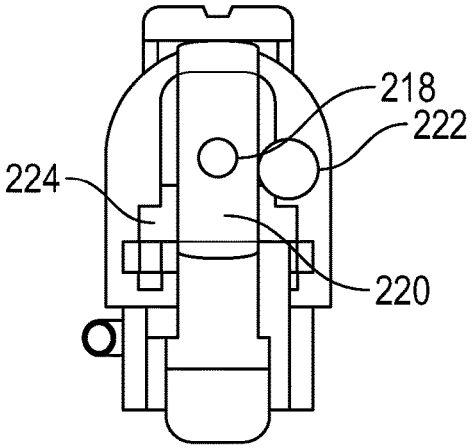
FIG. 6B shows a rear elevation view of a hammer assembly of the firearm of FIG. 4.
Figure 7:
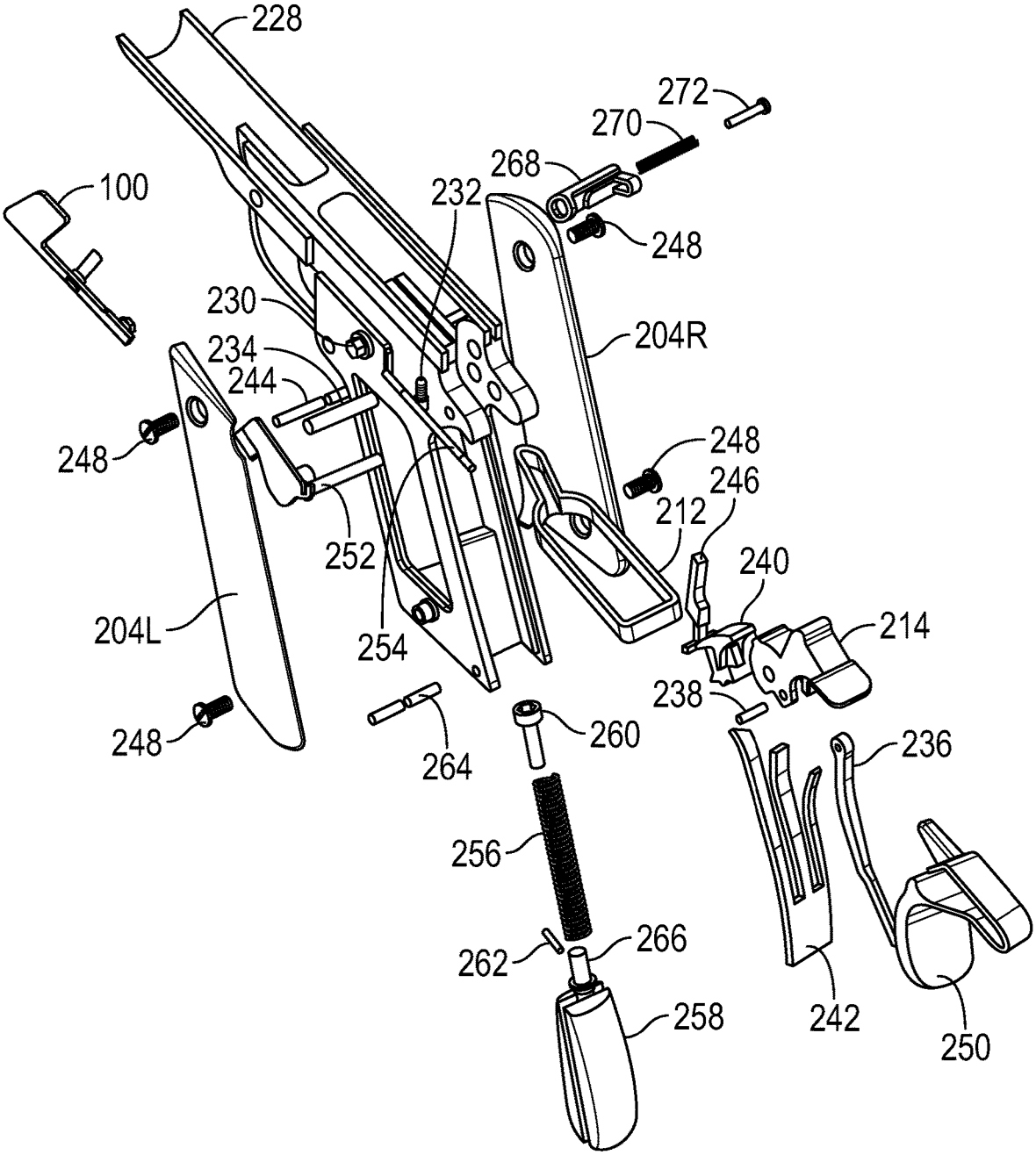
FIG. 7 shows an exploded view of a receiver group of the firearm of FIG. 4.
Figure 8:
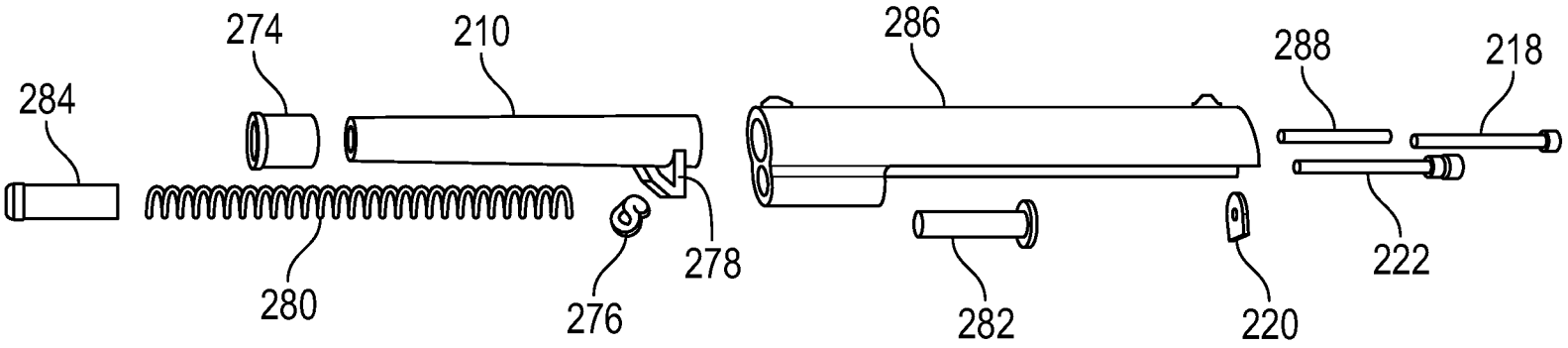
FIG. 8 shows an exploded view of a slide and barrel group of the firearm of FIG. 4.

With reference to FIG. 5 and each of FIGS. 6-9, the firearm 200 includes several groups of components that effect operation of the firearm. The several groups can include, but are not limited to including, the following: the improved slide stop 100 (FIGS. 1-2, 3A-3F, and 5) the hammer assembly (FIG. 5 and FIGS. 6A-6B), the receiver group (FIG. 5 and FIG. 7), the slide and barrel group (FIG. 5 and FIG. 8), and the magazine group (FIG. 5 and FIG. 8). It should be appreciated that some of the components within the firearm 200 are utilized by one or more of the several groups.

FIGS. 6A-6B show the hammer assembly, with a specific focus on how the hammer 214 interacts with the slide 208. The hammer assembly can include, but is not limited to including, the following components: the slide 208, the hammer 214, a firing pin 218, a stop 220 for the firing pin/striker 218, an extractor 222, an ejector 224, an ejector pin 226, and a receiver 228 which forms part of the frame 206 of the firearm 200.

In particular, the slide 208 is the upper part that slides with recoil during the operating cycle of the firearm 200. The slide 208 serves as the bolt carrier group and contributes to the receiver 228, and generally houses the firing pin 218, the extractor 222, and the barrel 208. The slide 208 provides a mounting platform for sights 304, 306.

As shown, the hammer 214 is the part of a firearm 200 that operates to strike the firing pin 218. The hammer 214 is a metal piece that forcefully rotates about a pivot point. After being operably struck by the hammer 214, the firing pin/striker 218 impacts a primer in the base of a cartridge and causes the firearm 200 to fire. A striker is a particular type of firing pin 218 in which a compressed spring (e.g., firing pin spring 288) acts directly on the firing pin 218 to provide the impact force rather than the firing pin 218 directly being struck by the hammer 214. A firing pin stop 220, when at rest, obstructs forward travel of the firing pin 218, and is operably linked to the trigger mechanism. The firing pin stop 220 aids in clearing obstruction(s) to the firing pin 218 just before the hammer 214 or firing pin 218 is released. This prevents the firing pin 218 from striking a chambered cartridge unless the trigger 212 is pulled, even if the hammer 214 is released due to a faulty sear (e.g., sear 240) or the firing pin 218 is dropped or struck by object other than the hammer 214.

The extractor 222 is an action component that serves to remove spent casings of previously fired cartridges from the chamber 300, in order to vacate the chamber 300 for loading a fresh round of ammunition. The extractor 222 can be a set of hook-like flanges on the bolt head that grab onto the casing's rim. When the bolt moves rearward, the casing is pulled out of the chamber 300. It is typically aided by a protruding ejector 224 in the receiver or the bolt, which provides an opposite counter-push that couples with the extractor 222 pull to expel the casing entirely out of the firearm 200.

Through the principles of short recoil or simple blowback operations, the slide 208 is moved backwards with each shot by the energy of expanding gasses caused by the combusting propellant, such as a nitrocellulose-based smokeless powder (modern), a black powder (historical), etc. Because the slide 208 is spring-loaded (spring 280; FIG. 8), once at the rearmost position, the spring tension will push it back toward the front. The movement of the slide 208 serves the following functions: the extractor 222 empties the chamber 300 by pulling out the spent casing from the previous shot (which then gets removed out of the firearm 200 by the ejector 224), the slide inertia will cock the hammer 214 and striker 218 to prepare for the next shot, and the bolt will push a new cartridge from the magazine into the chamber 300 when the slide 208 comes back forward. This action cycle will be repeated for continued firing as long as ammunitions are replete, and that there are no failure(s) to extract, eject, or feed.

Once the magazine is empty, the slide stop 100 will catch and lock the slide 208 at its rearmost position. The slide 208 will only be released to move back forward after a new magazine is inserted and the contact surface 110 slide stop 100 simultaneously pushed upward. Having the slide 208 automatically loading the chamber 300 and cocking the hammer 214/striker 218 with each prior shot is particularly beneficial for the function of double-action/single-action pistols.

FIG. 7 shows components of the receiver group. To facilitate proper operation of the receiver of the frame 206, the receiver group of the firearm 200 can include, but is not limited to including, the following components: the slide stop 100, a slide stop plunger 230, and a slide stop spring 232; the hammer 214, a hammer pin 234, a hammer strut 236, and a hammer strut pin 238; a sear 240, a sear spring 242, and a sear pin 244; a disconnector 246 attached to the sear 240; the trigger 212; left stock 204L and right stock 204R and screws 248 for the stocks 204L, 204R; a safety 250, a safety lock 252, and a safety plunger 254; a mainspring 256, a mainspring housing 258, a mainspring cap 260, a mainspring cap pin 262, a mainspring housing pin 264, and a mainspring retainer pin 266; a magazine catch 268, a magazine catch spring 270, and a magazine catch lock 272.

The slide stop plunger 230 can be a hardened pin which bears against the slide stop 100. More particularly, the slide stop plunger 230 rests on the slide stop 100 with just enough pressure to keep the slide 208 from locking open before the magazine is empty. The slide stop spring 232 rests on the thumb safety 250. The slide stop spring 232 helps eliminate slide stop 100 and thumb safety failures caused by a broken plunger 230.

The hammer pin 234 pivotably mounts the hook portion of the hammer 214 to the frame 206. The hammer strut pin 238 is mounted through a pair of holes in the hammer 214 and an aperture in the hammer strut 236. The hammer strut 236 is sandwiched between the pair of plates that contain the pairs of holes in the hammer 236 such that the aperture of the hammer strut 236 aligns with said holes.

The hook of the hammer 214 enables the double action mechanism to be fitted within the frame 206. The fit between the hammer strut pin 238 and the hammer 214 is preferably a light interference fit, e.g., the hammer strut pin 238 can be lightly tapped into the hammer 214 such that the hammer strut pin 238 cannot be removed therefrom by hand (without the use of tools). The hammer pin 234 and sear pin 244 together give a smooth hammer 214 and sear 240 rotation possible.

The sear 240 is pivotably mounted to the frame 206 by a sear pin 244. The bottom end of the sear 240 is biased forward by the sear spring 242. The disconnector 246 keeps the hammer in place until the trigger 212 is released and the sear 240 takes over. When the trigger 212 is still under pressure, the disconnector 246 will not retract to its resting position. A disconnector 246 captures the hammer 214 in the cocked position after a shot has been fired, even if the trigger 212 is held to the rear as the gun cycles. This ensures the firearm 200 can only fire in the semi-automatic mode, as the trigger 212 needs to be released to 'reset' and have the disconnector 246 release the hammer 214 back to the sear 240. The disconnector 246 also helps prevent out-of-battery "slamfire" malfunctions that occur when a hammer 214 follows the bolt carrier group forward as it closes.

A lock 252, which can be a firing pin block, is the main internal mechanism of the thumb-operated safety 250. The lock 252 which is disengaged by the disconnector 246 after the trigger 212 is pulled. Spring tension is placed on the disconnector 246 by the safety lock 252 and the safety plunger 254, which affects the weight of the trigger pull.

The hammer strut 236 is spring loaded by the mainspring 256 against the hammer strut pin 238. The hammer strut 236 engages the mainspring 242 through mainspring cap 260. The mainspring 256 engages the mainspring housing 258 through the mainspring cap pin 262, which acts as a roll pin, and the mainspring retainer pin 266.

The magazine catch 268, magazine catch spring 270 and magazine catch lock 272 are provided coupled to frame 206 to retain and release the magazine.

FIG. 8 shows components of the barrel group. To facilitate proper operation of the barrel 210, the barrel group of the firearm 200 can include, but is not limited to including, the following components: the barrel 210, a barrel bushing 274, a barrel link 276, a barrel link pin 278; a recoil spring 280, a recoil spring guide 282, and a recoil spring plug 284; a slide assembly 286; the firing pin 218, a firing pin stop 220, the extractor 222, and a firing pin spring 288.

A barrel link 276 connects the barrel 210 to the frame 206 with a barrel link pin 278. The barrel link pin 278 includes a slot and sits at the bottom rear portion of the barrel 210. The barrel link 276 causes the barrel 210 to move relative to the frame 206 when stimulated by the slide assembly 286.

The slide assembly 286 houses the recoil spring 280, which engages the recoil spring guide 282 that is coupled to frame 206. The recoil spring 280 biases the slide forward relative to frame 206. The recoil spring plug 284 is coupled to the slide assembly 286.

A main portion of the barrel 210 is located in the main channel of the slide assembly 286 and is guided by barrel bushing 274. The rear of the slide 208 has the firing pin 218. The firing pin 218 is preloaded by firing pin spring 288 against the firing pin stop 222. The extractor 222 is also retained in the slide by firing pin stop 220 for ejection of spent cartridges. The firing pin spring 288 is provided to prevent the firing pin from advancing to the cartridge when the firing pin is improperly engaged.

Figure 9:
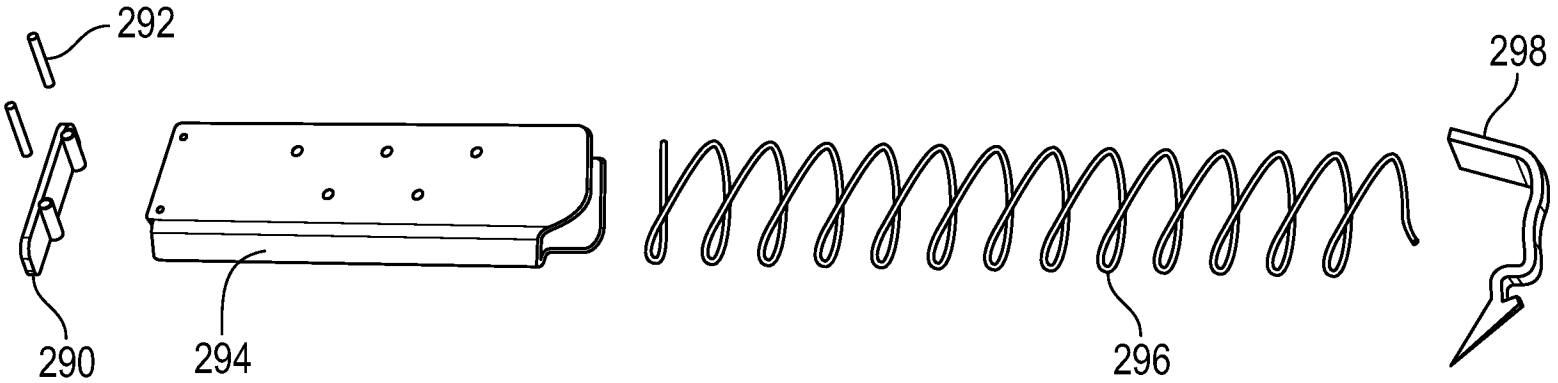
FIG. 9 shows an exploded view of a magazine group of the firearm of FIG. 4.

FIG. 9 shows components of the magazine group. To facilitate proper operation of the magazine and its cartridges (an individual unit of ammunition), the magazine group of the firearm 200 can include, but is not limited to including, the following components: a magazine base 290, magazine base pins 292; a magazine tube 294, a magazine spring 296, kinks and/or tension in the spring; and a follower 298.

The cartridge consists of a casing which contains the bullet, gunpowder, and a primer. When the primer is hit by the firing pin 218, a chemical reaction inside causes an explosion which ignites the powder, which burns rapidly, which increases the pressure within the enclosed cartridge dramatically. The resultant force propels the bullet forward and out of the barrel 210. Equal force also goes in the opposite direction, pushing the slide 208 back. This motion is used to eject the spent casing. Thereafter, the next cartridge is pushed forward by the spring 296 in the magazine into the barrel 210 and this cyclical process repeats until the magazine is completely emptied.

The magazine stores the cartridges and feeds cartridges to the repeating firearm 200. As shown, the magazine is removable from the firearm 200, which causes some to refer to the magazine as a clip. The magazine tube 294 includes a base 290 which is secured with magazine base pins 292. The magazine tube 294 functions holds several cartridges therewithin and works with the spring 296 to push each cartridge into a position where it may be readily loaded into the barrel chamber 300 by the firearm's moving action.

The follower 298 is the part of the magazine that the bullets rest upon. Beneath the follower 298 is the magazine spring 296. The magazine spring 296 pushes the follower 298. The follower 298 and the spring 296 keep the cartridge in tension. Bullets within the magazine tube 294 are pushed toward the bullet seat 302. This facilitates feeding rounds into the firearm 200. The magazine is designed only to push cartridges forward. When pulling the slide 208 back, the hammer 214 is cocked. Upon released the hammer 214, the recoil spring 280 snaps the slide 208 back forward, which upon its way grabs a cartridge from the magazine and puts it into the chamber 300 of the barrel 210. When the trigger 212 is pulled, the hammer 214 drops and strikes the firing pin 218, pushing the firing pin 218 forward.

After being emptied, the magazine can be released and replaced. The magazine is able to lock into place again by utilizing the magazine catch 268, the magazine catch spring 270, and the magazine catch lock 272.

From the foregoing, it can be seen that the present invention accomplishes at least all of the stated objectives.

WORKING EXAMPLE

FIGS. 10A-H illustrate a working example of the present invention implemented on an M1911. An average of four seconds was saved implementing the extended slide stop described herein when compared with use of a similar reloading method that implements only the OEM slide stop included with the M1911 at the time of purchase. The implemented method of FIGS. 10A-H was carried about so as to allow the firearm to achieve positions shown in FIGS. 10A-H, the order of said positions being achieved as you ascend in the alphabet from A-H. The worked example method can be described as follows.

Figure 10A:
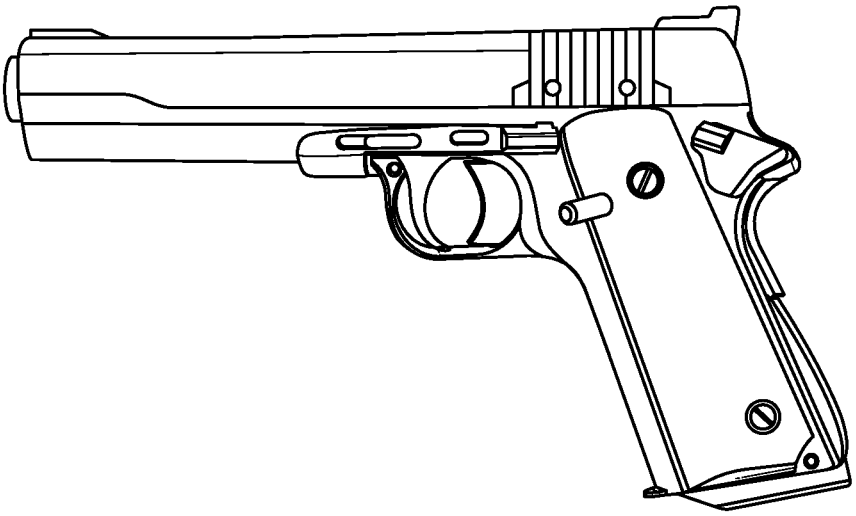
FIGS. 10A-H illustrate an operator working an example of an improved reloading method. In practice, this saves time during reloading.
Figure 10B:
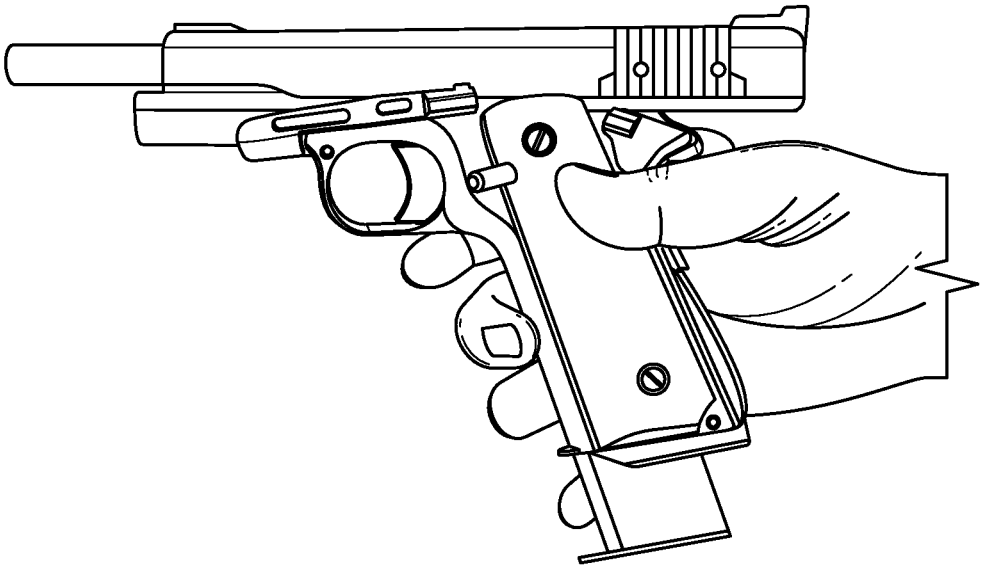
Figure 10C:
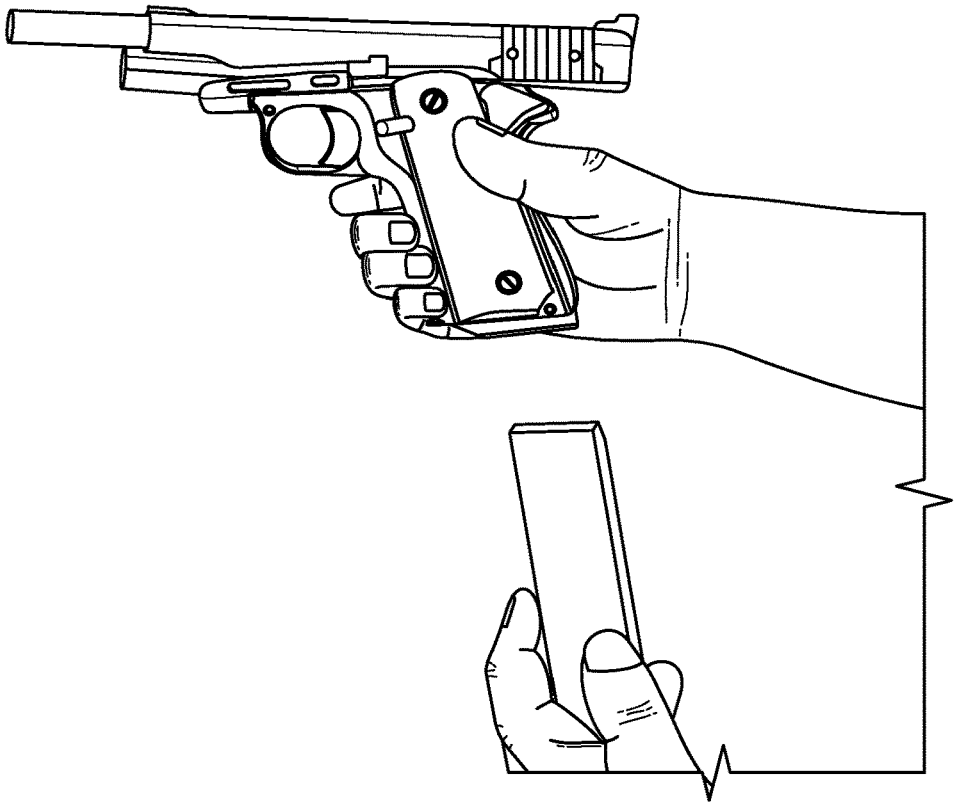
Figure 10D:
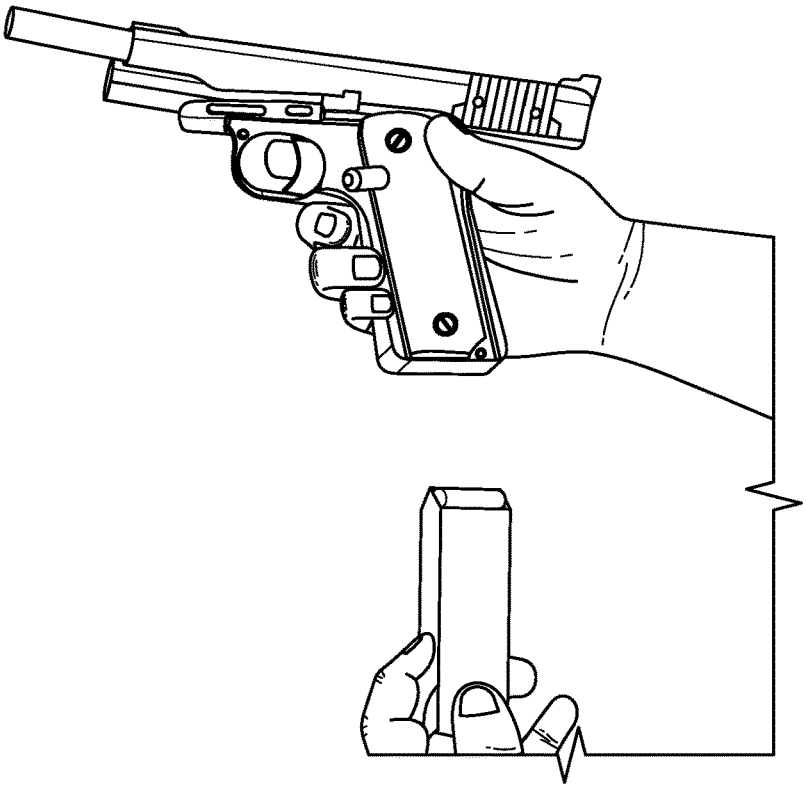
Figure 10E:
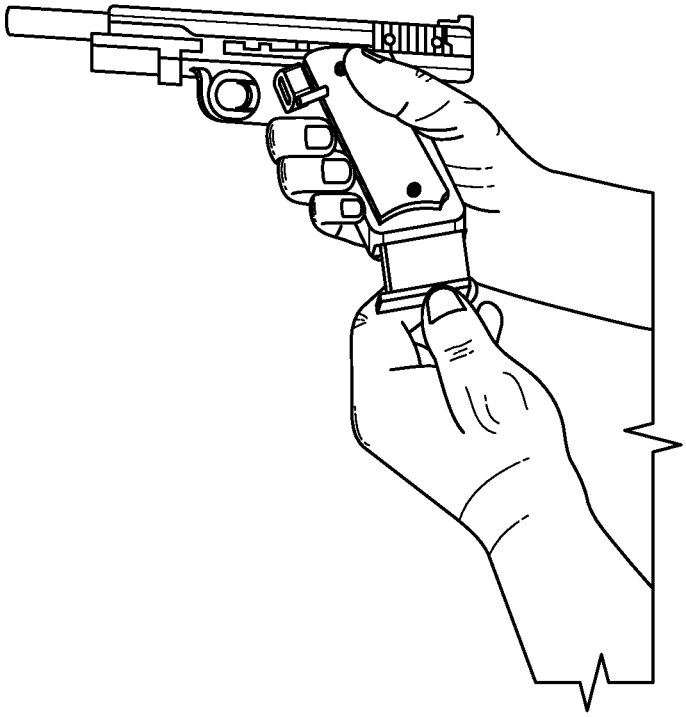
Figure 10F:
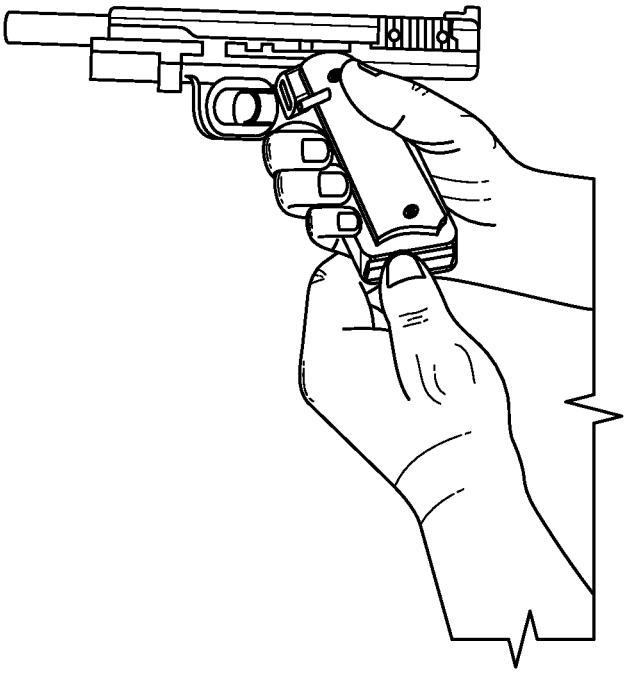
Figure 10G:
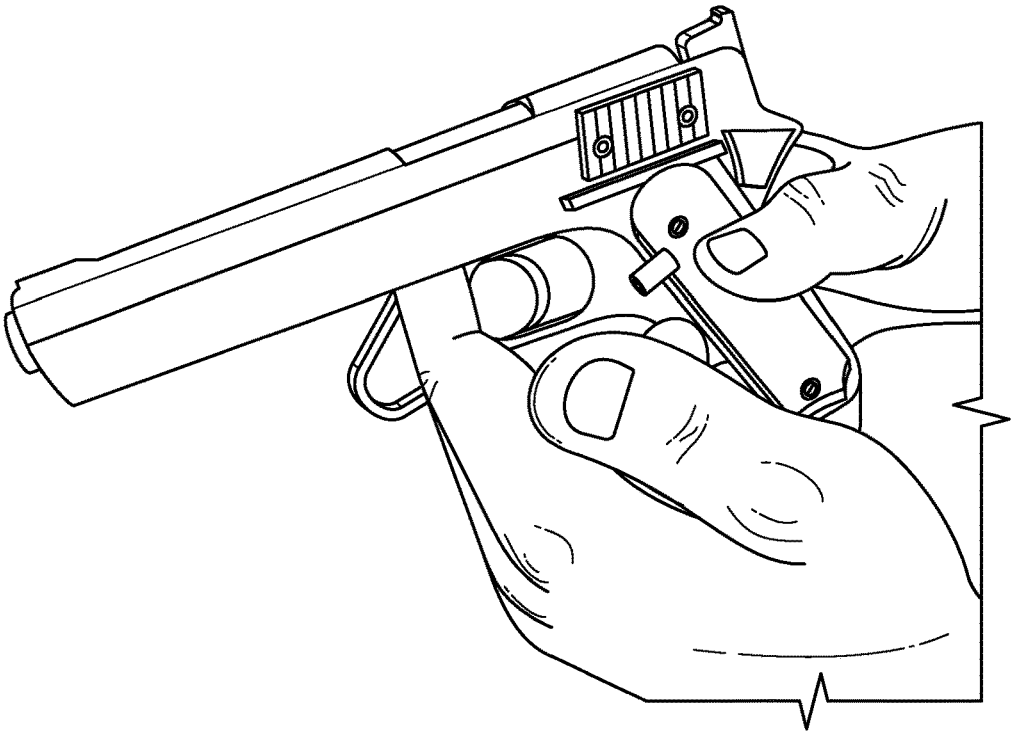
Figure 10H:
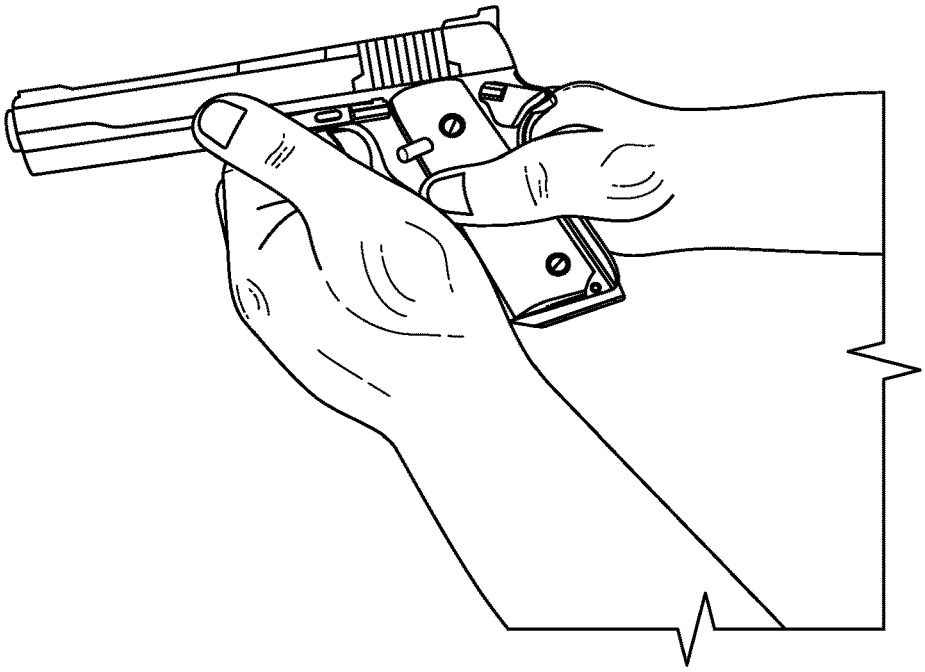

FIG. 10A shows the pistol in a forward position, ready for filing so long as the firearm includes a magazine with remaining cartridges. FIG. 10B shows the pistol in a recoil position, which occurs after the magazine is completely emptied. FIG. 10C shows an operator releasing the empty magazine from the firearm. FIG. 10D shows the operator acquiring a new, charged magazine. FIG. 10E shows the operator loading the charged magazine into the pistol. FIG. 10F shows the operator pressing the charged magazine into the pistol such that a catch of the magazine passes a receiver in the magazine seat and locks the magazine in place, with the pistol still in the recoil position. FIG. 10G shows the operator pushing upward on the contact surface of the extended slide stop to release the slide and put the firearm back into a forward position. FIG. 10H shows the operator becoming ready to fire the pistol once again.

LIST OF REFERENCE CHARACTERS

The following table of reference characters and descriptors are not exhaustive, nor limiting, and include reasonable equivalents. If possible, elements identified by a reference character below and/or those elements which are near ubiquitous within the art can replace or supplement any element identified by another reference character.

TABLE 1

| List of Reference Characters | |
|---|---|
| 100 | extended slide stop |
| 102 | body |
| 102A | first end |
| 102B | second end |
| 104 | first portion |
| 106 | second, extended portion |
| 108 | latch |
| 110 | contact surface |
| 112 | rod |
| 114 | first aperture |
| 116 | second aperture |
| 118 | offset |
| 200 | pistol |
| 202 | handle (with grip near the arrow) |
| 204 | stock (part of handle) |
| 206 | frame |
| 208 | slide |
| 210 | barrel |
| 212 | trigger |
| 214 | hammer |
| 216 | magazine seat |
| 218 | firing pin/striker |
| 220 | stop |
| 222 | extractor |
| 224 | ejector |
| 226 | ejector pin |
| 228 | receiver |
| 230 | side stop plunger |
| 232 | slide stop spring |
| 234 | hammer pin |
| 236 | hammer strut |
| 238 | hammer strut pin |
| 240 | sear |
| 242 | sear spring |

TABLE 1-continued

| List of Reference Characters | |
|---|---|
| 244 | sear pin |
| 246 | disconnector |
| 248 | stock screws |
| 250 | safety |
| 252 | safety lock |
| 254 | safety plunger |
| 256 | mainspring |
| 258 | mainspring housing |
| 260 | mainspring cap |
| 262 | mainspring cap pin |
| 264 | mainspring housing pin |
| 266 | housing pin retainer |
| 268 | magazine catch |
| 270 | magazine catch spring |
| 272 | magazine catch lock |
| 274 | barrel bushing |
| 276 | barrel link |
| 278 | barrel link pin |
| 280 | recoil spring |
| 282 | recoil spring guide |
| 284 | recoil spring plug |
| 286 | slide assembly |
| 288 | firing pin spring |
| 290 | magazine base |
| 292 | magazine base pins |
| 294 | magazine tube |
| 296 | magazine spring |
| 298 | follower |
| 300 | chamber |
| 302 | bullet seat |
| 304 | rear sight |
| 306 | front sight |
| 308 | lanyard loop |

GLOSSARY

Unless defined otherwise, all technical and scientific terms used above have the same meaning as commonly understood by one of ordinary skill in the art to which embodiments of the present invention pertain.

The terms "a," "an," and "the" include both singular and plural referents.

The term "or" is synonymous with "and/or" and means any one member or combination of members of a particular list.

The terms "invention" or "present invention" are not intended to refer to any single embodiment of the particular invention but encompass all possible embodiments as described in the specification and the claims.

The term "about" as used herein refer to slight variations in numerical quantities with respect to any quantifiable variable. Inadvertent error can occur, for example, through use of typical measuring techniques or equipment or from differences in the manufacture, source, or purity of components.

The term "substantially" refers to a great or significant extent. "Substantially" can thus refer to a plurality, majority, and/or a supermajority of said quantifiable variable, given proper context.

The term "generally" encompasses both "about" and "substantially."

The term "configured" describes structure capable of performing a task or adopting a particular configuration. The term "configured" can be used interchangeably with other similar phrases, such as constructed, arranged, adapted, manufactured, and the like.

Terms characterizing sequential order, a position, and/or an orientation are not limiting and are only referenced according to the views presented.

The "scope" of the present invention is defined by the appended claims, along with the full scope of equivalents to which such claims are entitled. The scope of the invention is further qualified as including any possible modification to any of the aspects and/or embodiments disclosed herein which would result in other embodiments, combinations, subcombinations, or the like that would be obvious to those skilled in the art.

What is claimed is:

1. An extended slide stop comprising: an elongated body comprising: a first end; a second end located opposite the first end; a mechanism for releasing a slide of a firearm, said mechanism located near the first end; a contact surface extending from the second end, said contact surface being at least twice as wide as a width of the elongated body near said second end; and a mountable member extending away from a central location of the body at a substantially orthogonal angle, wherein the body comprises a first portion extending from the first end to the mountable member and a second, extended portion from the mountable member to the second end; and further comprising a first, elongated aperture centrally located within the first portion.

2. The extended slide stop of claim 1 wherein the contact surface is curved concave toward the direction that the rod extends from the elongated body.

3. The extended slide stop of claim 1 wherein the mechanism is a latch.

4. The extended slide stop of claim 1 wherein the mountable member is a rod.

5. The extended slide stop of claim 1 wherein the body comprises a raised surface at the first end, said raised surface being raised from the body in a direction opposite the direction the mountable member extends away from the body.

6. The extended slide stop of claim 1 wherein the first portion, the second, extended portion, and the contact surface each comprise approximately the same length.

7. The extended slide stop of claim 1 further comprising a second, elongated aperture located partially within the second, extended portion and partially within the contact surface.

8. An extended slide stop comprising: an elongated body comprising: a first end; a second end located opposite the first end; a mechanism for releasing a slide of a firearm, said mechanism located near the first end; a contact surface extending from the second end, said contact surface being at least twice as wide as a width of the elongated body near said second end; and a mountable member extending away from a central location the body at a substantially orthogonal angle, wherein the body comprises a first portion extending from the first end to the mountable member and a second, extended portion from the mountable member to the second end; and further comprising a second, elongated aperture located partially within the second, extended portion and partially within the contact surface.

9. The extended slide stop of claim 1 wherein the mountable member is configured to act as a fulcrum such that when an operator presses downward on the first portion, the second, extended portion travels upward, and vice-versa.

10. A firearm comprising: a handle comprising a grip; a frame extending substantially orthogonal to said handle; a slide slidably attached at a top of the frame; a barrel located within the frame and the slide; the extended slide stop of claim 1, wherein the contact surface of the extended slide stop is located at a more forward position of the firearm than the trigger; and a trigger that when pulled, allows a hammer to release a bullet through said barrel if a cartridge containing the bullet is located within a magazine properly seated within the firearm.

11. The firearm of claim 10 wherein: the extended slide stop is retrofit for said firearm; and the extended slide stop is designed to change a direction in which the operator must rotate the extended slide stop in order to release a slide of the firearm.

12. The firearm of claim 10 further comprising a seat for a magazine, said seat being located within the handle.

13. The firearm of claim 10 wherein the firearm is a single-action, semi-automatic, magazine-fed, recoil-operated pistol.

14. The firearm of claim 10 wherein the firearm is a polymer-framed, short recoil-operated, locked-breech semi-automatic pistol.

15. A method of assembling the firearm of claim 10 further comprising replacing an existing slide stop with the extended slide stop.

16. A method of reloading the firearm of claim 12 comprising releasing a magazine from the seat and reloading a charged magazine into the seat.

17. A method of transitioning the firearm of claim 10 from a recoil position to a forward position, said method comprising pushing upward on the contact surface to release the slide.

18. The method of claim 17 wherein the slide comprises a spring.

19. A method for firing the firearm of claim 1, said method comprising pulling said trigger.

* * * * *